US005865149A

United States Patent [19]

Patel

[11] Patent Number: 5,865,149

[45] Date of Patent: Feb. 2, 1999

[54] BUCKSTAY CORNER ASSEMBLY WITH BUCKSTAY EXTENSION PLATES FOR A BOILER

[75] Inventor: Kasanbhai C. Patel, Windsor Locks, Conn.

[73] Assignee: Combustion Engineering, Inc., Windsor, Conn.

[21] Appl. No.: 772,445

[22] Filed: Dec. 23, 1996

[51] Int. Cl.[6] ..... F22B 37/24

[52] U.S. Cl. ..... 122/510; 122/511; 122/6 A

[58] Field of Search ..... 122/6 A, 510, 122/511, 512

[56] References Cited

U.S. PATENT DOCUMENTS

| | | | |
|---|---|---|---|
| 3,760,774 | 9/1973 | Michel | 122/6 A |
| 3,814,063 | 6/1974 | Bijmholt | 122/6 A |
| 3,861,360 | 1/1975 | Shank, Jr. | 122/6 A |
| 4,059,075 | 11/1977 | Ssinegurski et al. | 122/6 A |
| 4,240,234 | 12/1980 | Eisinger et al. | 122/6 A |
| 5,207,184 | 5/1993 | Kreider | 122/510 |
| 5,282,442 | 2/1994 | Payne | 122/510 |
| 5,299,535 | 4/1994 | Payne | 122/510 |
| 5,557,901 | 9/1996 | Hoosic et al. | 122/510 |

OTHER PUBLICATIONS

Steam: Its Generation and Use, The Babcock & Wilcox Co., pp. 14–7—14–8, 1963.

*Primary Examiner*—John A. Jeffery
*Assistant Examiner*—Gregory A. Wilson
*Attorney, Agent, or Firm*—Robert S. Smith

[57] ABSTRACT

A buckstay system of an associated furnace having a combustion cavity with a front waterwall, a rear waterwall, and opposed left and right side waterwalls joining the front and rear waterwalls and where the waterwalls are arranged in a generally square pattern about the cavity. The cavity has four corners and each buckstay an attachment module welded to each end, each attachment module includes first and second planar plates. The first and second planar plates are disposed in side abutting relationship to the web of the buckstay and extend beyond the end of the buckstay, each of the first and second plates have coaxial pivot holes disposed in a part thereof that extends beyond the end of the buckstay. The planar plates in the attachment module my be rectangular. Or have a notch or recess for clearance. A spacer may be disposed intermediate the planar plates in the attachment module and the spacer may have a thickness substantially equal to the thickness of the web of the buckstay for which the attachment module is intended.

5 Claims, 4 Drawing Sheets

BUCKSTAY CORNER ASSEMBLY WITH BUCKSTAY EXTENSION PLATES FOR A BOILER

TECHNICAL FIELD

The invention relates to boilers such as large utility boilers that are disposed in a frame that is provided to withstand the internal furnace gas pressure. As the furnace approaches operating temperature, the furnace walls expand vertically and horizontally. Additionally, the pressure excursions within the furnace, either an increase or a decrease in pressure within the furnace, cause a resultant additional flexing of the tube walls either inwardly or outwardly in a horizontal direction.

It has become customary and necessary to provide an arrangement of flanged girder beams, typically referred to as buckstays, that extend around the furnace to provide additional support to the furnace wall and prevent the dishing of the furnace walls in a horizontal direction because of pressure variations. More particularly, the arrangement typically uses both vertical and horizontal structural members that are respectively known as vertical and horizontal buckstays.

Typically, the horizontal buckstays are disposed in bands around the perimeter of the furnace tube walls at vertically spaced intervals (often between 10 and 15 feet) throughout the height of the furnace wall. Horizontally, the buckstays on opposite walls of the furnace are interconnected through buckstay ties so that the reaction of one buckstay is resisted by the reactions of the buckstay on the opposing wall so it can counteract the pressure forces acting on the furnace walls. It has been customary to provide vertical support members (levelers) to interconnect adjacent buckstays with a connection that permits a sliding action that permits relative movement between the furnace tube wall with which a buckstay cooperates and the buckstays themselves. As the furnace expands in a vertical direction the effect on the various levels of buckstays will be different. This will be apparent because the elongation of the furnace tube walls will be different at different points in the furnace.

Because of the temperature differential between the furnace wall and the buckstays it is preferred to locate the buckstays a short distance from the furnace wall with insulation therebetween. Apparatus referred to as stirrups are used to make this connection between the furnace wall and the respective buckstays. The skirt is a device known in the art which allows gas pressure loading to be transmitted from the furnace tube walls to the buckstay systems while allowing unrestricted thermal expansion of the boiler tube wall envelope. Known stirrup constructions are disclosed in U.S. Pat. Nos. 4,395,860 and 4,059,075. These stirrups may be connected to the furnace wall and operate to support the buckstay as well as to prevent relative inward or outward movement between the buckstay and the wall.

There have been a number of different approaches to buckstays and stirrups. See, for example, U.S. Pat. Nos. 5,282,442; 5,299,535; and 5,317,993. All of these patents have been issued to Ronald G. Payne and have the same assignee as the present invention.

Conventional buckstay constructions require shipment of rolled shapes, used in the fabrication of the buckstays, and wall channels from the steel rolling mill or warehouse to a fabrication shop. In the fabrication shop the rolled shapes are cut and machined to produce the surfaces for connection of the various elements in the buckstay system. The dimensions and contours of the surfaces for connection of the various elements are produced in accordance with drawings for the entire furnace. Thereafter, the buckstay assemblies on which shop detailing and fabrication procedures have been completed are shipped to the field site at which the furnace is assembled. In the event of a problem at the field site there is very little that can be done other than to either procure new rolled shapes from a rolling mill or warehouse and have them cut and machined in the fabrication shop or return the original buckstays which have already been cut and machined to the fabrication shop for further work. Because of the expenses involved in shipping large channels and the time delay caused by such shipping and duplicate fabrication shop procedures this sequence is not satisfactory. The problem is further accentuated by the inability of conventional buckstay systems to accommodate dimensional variations. Since normal manufacturing operations inherently require tolerances there are a series of problems inherent in the conventional buckstay systems.

OBJECTS AND SUMMARY OF THE INVENTION

It is an object of the present invention to provide apparatus which allow field fabrication of the buckstay system so that the rolled shapes for the buckstays and wall channels can be shipped directly from the rolling mill or warehouse directly to the field site without the need to be shipped to a fabrication shop.

Another object of the invention is to provide apparatus that will allow field changes in the structural elements to accommodate tolerance buildup and other dimensional problems identified at the field site.

It is an object of the invention to provide a structure that will accommodate a greater range of cooperating parts so that less parts need be stockpiled for future use.

Yet another object of the present invention is to provide structural elements in the buckstay system that are simple and inexpensive to fabricate.

It has now been found that these and other objects of the invention may be attained with a buckstay attachment module for use as part of the buckstay system of an associated furnace having a combustion cavity with a front waterwall, a rear waterwall, and opposed left and right side waterwalls joining the front and rear waterwalls and where the waterwalls are arranged in a generally square pattern about the cavity. The cavity has four corners and each buckstay an attachment module welded to each end, each attachment module includes first and second planar plates. The first and second planar plates are disposed in side abutting relationship to the web of the buckstay and extend beyond the end of the buckstay, each of the first and second plates have coaxial pivot holes disposed in a part thereof that extends beyond the end of the buckstay. The planar plates in the attachment module my be rectangular. Or have a notch or recess for clearance. A spacer may be disposed intermediate the planar plates in the attachment module and the spacer may have a thickness substantially equal to the thickness of the web of the buckstay for which the attachment module is intended.

BRIEF DESCRIPTION OF THE DRAWING

The invention will be better understood by reference to the accompanying drawing in which.

DESCRIPTION OF THE PREFERRED EMBODIMENT

Figure 1:
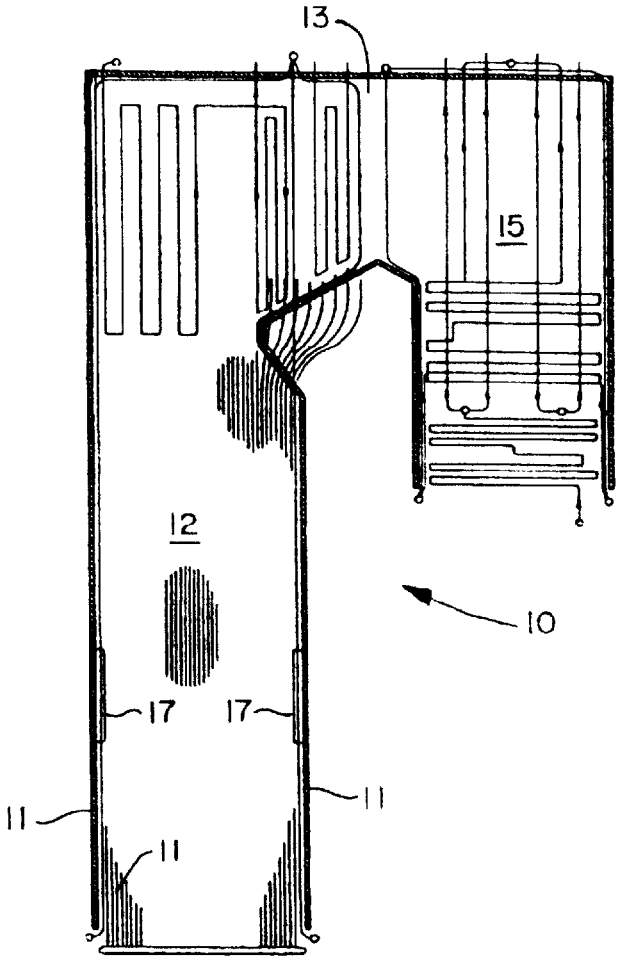
FIG. 1 is a side elevational view of a furnace that may utilize the present invention.

Referring now to FIG. 1 there is shown a conventional furnace 10, having a central cavity 12 surrounded by a front wall, a rear wall and two opposed side walls. The side walls (not shown) are disposed in spaced relationship and join the front wall and the rear wall. Each of these walls is a waterwall 11 comprising a plurality of substantially parallel, substantially coplanar tubular members.

The furnace 10 is vertically disposed and has an outlet for combustion gases at its upper end extending from the rear wall thereof. Extending from this outlet is a lateral gas pass 13 which connects with the upper end of a vertically extending gas pass 15 that extends downwardly in parallel relation with the cavity 12. Combustion gases sequentially pass through the cavity 12, the lateral gas pass 13, the vertically extending gas pass 15 and a stack (not shown). The illustrated furnace 10 includes burners 17. It will be understood the present invention may be incorporated in a wide variety of furnace structures and that the illustrated furnace 10 is only one such furnace.

Figure 2:
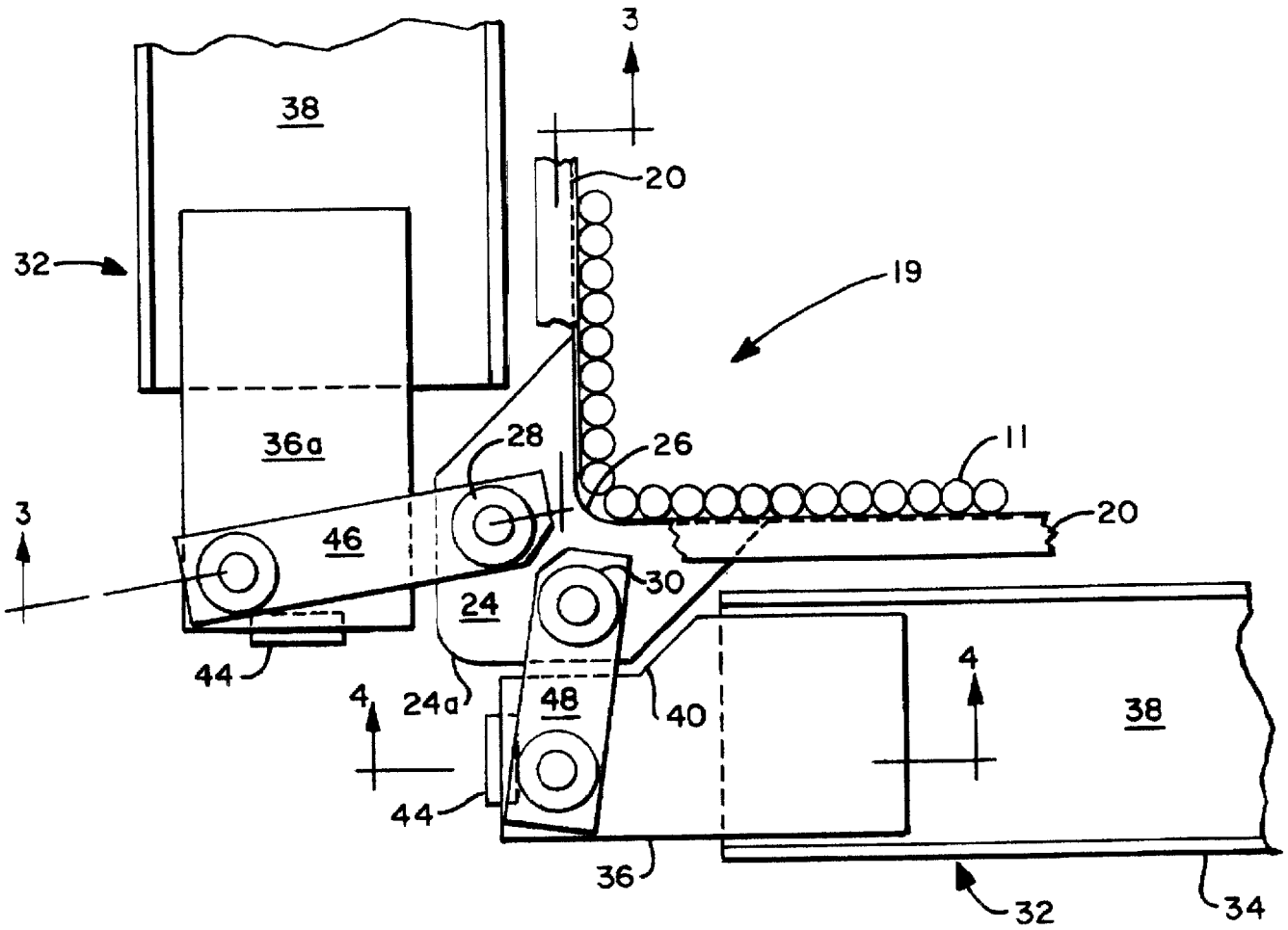
FIG. 2 is a plan view of a preferred embodiment of a buckstay corner assembly in accordance with the present invention.
Figure 3:
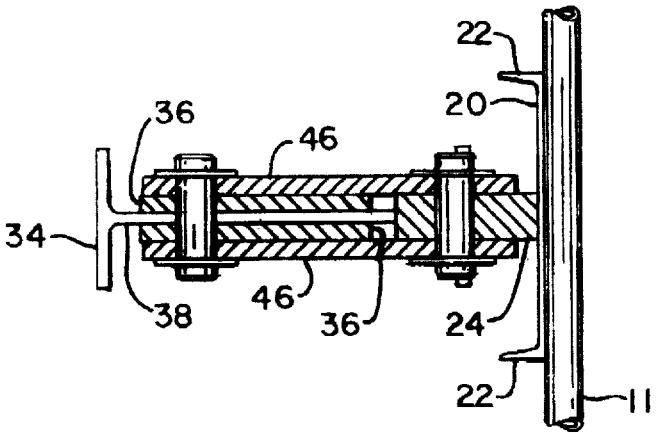
FIG. 3 is a partially sectional view taken along the line 3—3 of FIG. 2.
Figure 4:
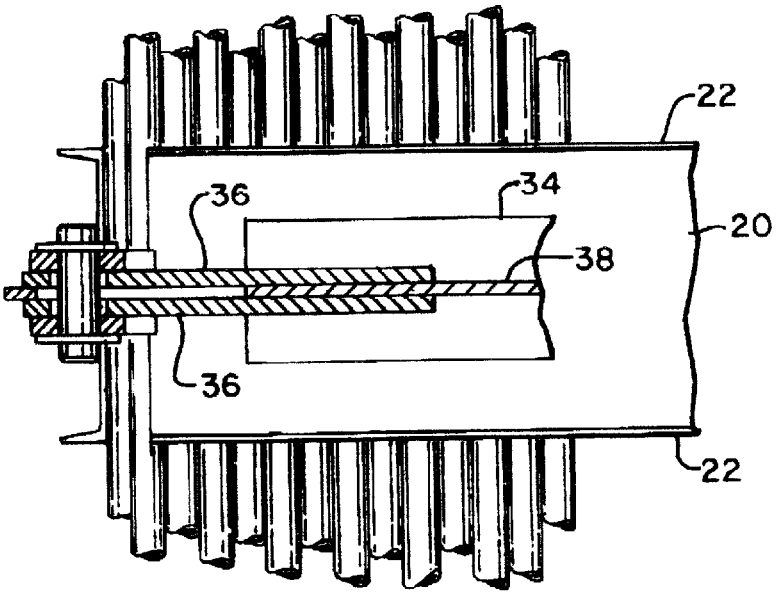
FIG. 4 is a partially sectional view taken along the line 4—4 of FIG. 2.
Figure 5:
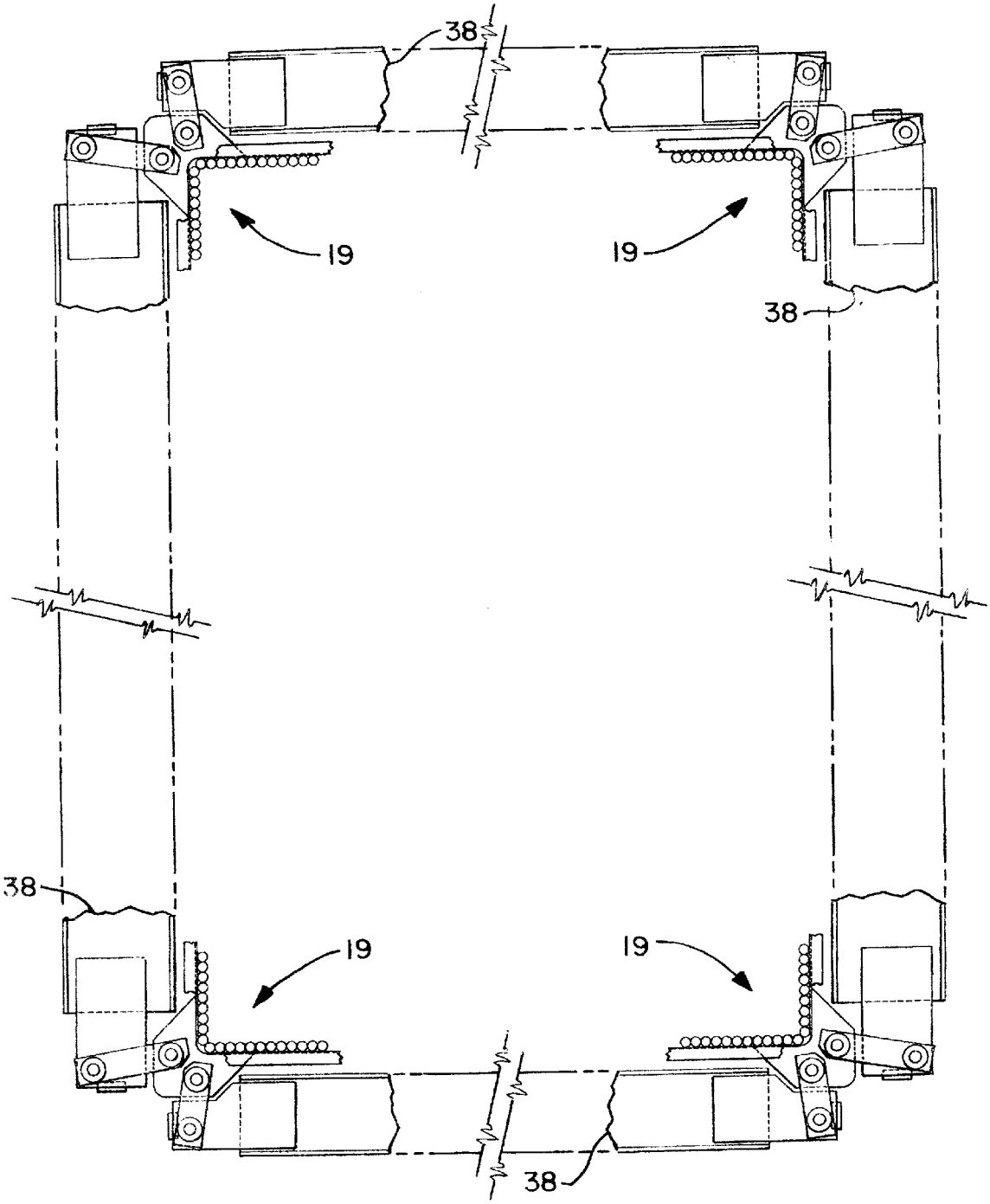
FIG. 5 is a partially sectional fragmentary view of an entire buckstay assembly for a furnace.

The apparatus in accordance with one form of the present invention is shown in FIGS. 2–5. FIG. 5 illustrates the four corners assemblies 19 that are disposed at the corners of the cavity 12. Each of these assemblies 19 are substantially identical. Thus, the view of FIG. 2 is a more detailed representation of each such assembly 19.

In the plan view of FIG. 2 the cross-sections of the individual tubular members that collectively make up the waterwall 11, are shown somewhat schematically. In the conventional manner the outer face of the waterwall 11 has a horizontally extending wall channel 20 disposed in face abutting relationship to the waterwall 11. More specifically, the wall channel 20 has a planar face that abuts the waterwall 11. The opposed face of the wall channel 20 has peripheral horizontally extending flanges 22, 22. Although FIG. 2 shows only one corner at which two waterwalls intersect it will be understood that each furnace 10 will ordinarily have four such corners at which two waterwalls will intersect as well as two wall channels 20, 20 disposed on respective waterwalls.

Welded to the respective wall channels 20 near a corner of the waterwall 11 is a corner plate 24. The corner plate 24, in the preferred embodiment has a V-shaped end 26 having the respective sides of the V-shaped end 26 configured with a 90 degree included angle. Thus, the V-shaped end is securely fixed to the wall channels 20. The corner plate 24 extends away from the waterwall and has holes therein for receiving pins 28, 30. The other contours of the corner plate 24 are dictated primarily by the need to provide clearance with respect to the other moving parts of the buckstay system. In the preferred embodiment, the corner plate 24 has a nose shaped end 24*a* having sides that respective faces of the waterwall 11. The corner plates 24 are provided at each of the four corners of the furnace 10. Collectively they support the horizontal furnace design pressure load imposed on the buckstays 32.

Each buckstay 32 in the preferred embodiment comprises an I beam 34 and a connection module. Each connection module may be either a pair of spaced extension plates 36 or a pair of spaced extension plates 36*a*. FIG. 2 illustrates alternate contours of the extension plates. The extension plates 36*a* are generally rectangular and the extension plates 36 are notched to provide clearance with respect to the corner plate 24. As will be observed with respect to the plates 36*a* it is not necessary to have a notch 40 for clearance with respect to the corner member 24 if the rectangular plates 36*a* are laterally offset as shown in FIG. 2.

More specifically, disposed at each axial extremity of each I beam 34 there are two extension plates 36. As best seen in FIG. 4 the two extension plates 36 are both planar and are disposed in parallel spaced relationship with one planar face of each extension plate 36 being disposed in face abutting relationship to one of the opposed faces of the web 38 of the I-beam 34. Each extension plate 36, in the preferred embodiment, includes a notch or recess 40 to provide clearance with respect to the corner plate 24. Each pair of extension plates 36 is also provided with a spacer 44 to maintain the pair of plates 36, 36 in spaced parallel relationship. Similarly, a spacer 44 is disposed intermediate the pair of rectangular plates 36*a* to maintain the plates 36*a*, 36*a* in spaced parallel relationship. The thickness of the spacers 44 ordinarily will be the same as the thickness of the web 38 of the buckstay 32.

Joining the corner plate 24 to the respective buckstays 32, 32 are respective links 46, 48. As best seen in FIG. 3 the links 46 are used in pairs. More specifically, each link 46 is generally planar and a pair of links 46 disposed in parallel relationship are used to couple the corner plate 24 to the buckstay 34. As best seen in FIG. 3 the links 46 are arrayed in a sandwich like arrangement in which the links 46 are disposed in face abutting relationship to the outer faces of the corner plate 24 and the outer faces of the extension plates 36, 36.

It will be seen that the module comprising (a) a pair of plates 36, 36 and a spacer 44 or (b) a pair of plates 36*a*, 36*a* and a spacer 44 is critical to facilitating field fabrication of horizontal buckstays. The modules can be shop or field fabricated and then the channel can be torch cut to the required length at the job site followed by welding one of the standard modules on the end of the channel.

The invention has been described with reference to its illustrated preferred embodiment. Persons skilled in the art of such devices may upon disclosure to the teachings herein, conceive other variations. Such variations are deemed to be encompassed by the disclosure, the invention being delimited only by the following claims.

Having thus described my invention, I claim:

1. A buckstay apparatus for an associated furnace having a combustion cavity with a front waterwall, a rear waterwall, and opposed left and right side waterwalls joining said front and rear waterwalls, said waterwalls being arranged in a generally square pattern about said cavity, said cavity having four corners, said buckstay apparatus comprising:

front, rear, left and right generally horizontal wall channels being welded on the outer face of each of said front, rear, left and right waterwalls at substantially the same elevation, each of said wall channels extending between two of said corners, two of said wall channels being fixed together at each of said corners;

a corner member welded to each intersection of said wall channels disposed at each corner, each said corner members having first and second pivot holes disposed therein;

a buckstay extending generally horizontally across and spaced from each of said front, rear, left and right waterwalls, each buckstay having first and second ends and a web shaped surface;

each buckstay having an attachment module welded to each end, each attachment module including first and second planar plates, said first and second planar plates being disposed in side abutting relationship to said web of said buckstay and extending beyond the end of said buckstay, each of said first and second plates in each module having mutually coaxial pivot holes disposed in a part thereof that extends beyond the end of the buckstay;

said first and second pivot holes in each of said corner members each being linked to one of said coaxial pivot holes in said first and second plates in one of said attachment modules carried on one end of a buckstay by first and second link members, each of said link members being mutually parallel planar members; and pivot pins coupling each of said pivot holes in each of said corner members to said mutually coaxial pivot holes in said first and second plates in one of said attachment modules a spacer is disposed intermediate said planar plates in said attachment module, said spacer have a thickness substantially equal the thickness of the web of the buckstay for which the attachment module is intended and said planar plates in said attachment module are rectangular.

2. The apparatus as described in claim 1, wherein:

said planar plates in said attachment module have a notch therein for clearance.

3. The apparatus as described in claim 2, wherein:

a spacer is disposed intermediate said planar plates in said attachment module, said spacer has a thickness substantially equal to the thickness of the web of the buckstay for which the attachment module is intended.

4. A buckstay apparatus for an associated furnace having a combustion cavity with a front waterwall, a rear waterwall, and opposed left and right side waterwalls joining said front and rear waterwalls, said waterwalls being arranged in a generally square pattern about said cavity, said cavity having four corners, said buckstay apparatus comprising:

a buckstay extending generally horizontally across and spaced from each of said front, rear, left and right waterwalls, each buckstay having first and second ends and a web shaped surface;

each buckstay having an attachment module welded to each end, each attachment module including first and second planar plates, said first and second planar plates being disposed in side abutting relationship to said web of said buckstay and extending beyond the end of said buckstay, each of said first and second plates in each module having mutually coaxial pivot holes disposed in a part thereof that extends beyond the end of the buckstay;

said first and second pivot holes in each of said corner members each being linked to one of said coaxial pivot holes in said first and second plates in one of said attachment modules carried on one end of a buckstay by first and second link members, each of said link members being mutually parallel planar members; and pivot pins coupling each of said pivot holes in each of said corner members to one said mutually coaxial pivot holes in one of said first and second plates in one of said attachment modules, said planar plates in said attachment module being rectangular said apparatus further including a spacer disposed intermediate said planar plates in said attachment module, said spacer have a thickness substantially equal the thickness of the web of the buckstay for which the attachment module is intended.

5. The apparatus as described in claim 4, wherein:

said planar plates in said attachment module have a notch therein for clearance.

* * * * *